US008245868B2

(12) United States Patent
Ikeda et al.

(10) Patent No.: US 8,245,868 B2
(45) Date of Patent: Aug. 21, 2012

(54) CASE LOCKING MECHANISM

(75) Inventors: Kenji Ikeda, Kariya (JP); Hirotsugu Kojima, Kariya (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 338 days.

(21) Appl. No.: 12/424,085

(22) Filed: Apr. 15, 2009

(65) Prior Publication Data

US 2009/0260996 A1 Oct. 22, 2009

(30) Foreign Application Priority Data

Apr. 18, 2008 (JP) ..... 2008-109061

(51) Int. Cl.
*B65D 45/16* (2006.01)

(52) U.S. Cl. ..... 220/324; 220/326; 220/835; 206/1.5

(58) Field of Classification Search ..... 220/4.21, 220/4.22, 4.23, 324, 326, 835; 206/1.5
See application file for complete search history.

(56) References Cited

U.S. PATENT DOCUMENTS

| | | | | |
|---|---|---|---|---|
| 4,170,315 | A * | 10/1979 | Dubach et al. | 220/281 |
| 4,924,561 | A | 5/1990 | Yoneyama | |
| 5,137,260 | A * | 8/1992 | Pehr | 215/216 |
| 6,196,755 | B1 | 3/2001 | Okorocha et al. | |
| 6,886,688 | B2 * | 5/2005 | Sykes et al. | 206/308.2 |
| 2003/0098252 | A1 | 5/2003 | Sykes et al. | |

FOREIGN PATENT DOCUMENTS

| | | |
|---|---|---|
| JP | 48-030528 | 9/1973 |
| JP | 60-145770 | 9/1985 |
| JP | 64-038308 | 3/1989 |
| JP | 2-093146 | 7/1990 |
| JP | 11-013718 | 1/1999 |
| JP | 2002-544548 | 12/2002 |
| JP | 2005-023860 | 1/2005 |
| JP | 2005-023860 A | 1/2005 |
| JP | 3114695 | 10/2005 |
| JP | 2005-337064 | 12/2005 |
| JP | 2005-337064 A | 12/2005 |
| JP | 2008-075696 | 4/2008 |

OTHER PUBLICATIONS

English language Abstract of JP 2005-023860 A, Jan. 27, 2005.
English language Abstract of JP 2005-337064 A, Dec. 8, 2005.

* cited by examiner

*Primary Examiner* — Anthony Stashick
*Assistant Examiner* — Madison L Wright
(74) *Attorney, Agent, or Firm* — Greenblum & Bernstein, P.L.C.

(57) ABSTRACT

Lock mechanisms are provide between a first case part and a second case part, which are openable and closable. Projections are formed on an outer side surface of the first case part. Each projection has a stopper hole that extends along a circumferential direction of the outer side surfaces of the case parts. U-shaped deformable pieces are formed with the outer side surface of the second case part and each deformable piece can be deformed in a direction perpendicular to the outer side surface of the second case part. A hook portion is formed with a distal portion of each deformable piece. Guide portions are formed at an edge of an entrance of the stopper hole and guide the hook portion toward the stopper hole. Holding portions are formed at an edge of an exit of the stopper hole and hold claw portions of the hook portion.

4 Claims, 8 Drawing Sheets

CASE LOCKING MECHANISM

BACKGROUND OF THE INVENTION

The present invention relates to a case locking mechanism that is used in a case having two openable case parts, such as the case of an air cleaner connected to the intake system of a vehicle engine, and holds the case parts in a closed state.

Conventionally, as a locking mechanism for holding this sort of case in a closed state, one type is known in which metal clamp member is attached to one of the case parts. The clamp member is hooked to the other case part, so that the two case parts are held in a closed state. This conventional holding mechanism requires a metal member used as the clamp member, which is prepared separately from the case parts. This can complicates the structure of the mechanism.

In order to eliminate such a drawback, for example, Japanese Laid-Open Patent Publication Nos. 2005-23860 and 2005-337064 each disclose a structure in which a member that corresponds to the clamp member is integrally formed with case parts.

In the structure disclosed in Japanese Laid-Open Patent Publication No. 2005-23860, a synthetic resin cover body is pivotally attached with a hinge to a synthetic resin case body. The cover body pivots relative to the case body, so that the cover body and the case body are selectively opened and closed. A holding mechanism is provided between the open ends of the case body and the cover body. The holding mechanism holds the cover body in a closed state with respect to the case body. Specifically, an elongated insertion hole extending vertically is formed on an outer side surface of the case body, and a pair of hook claws corresponding to the insertion holes are formed on an outer side surface of the cover body. Each hook claw has at its distal end a claw portion that can be inserted into the insertion hole. The hook claws are each formed integrally with the cover body with a linear elastically deformable piece in between. The deformable pieces are formed to be elastically deformable along a direction parallel with the outer side surface of the cover body.

When the cover body is pivoted from an open position to a closed position with respect to the case body, a distal guide surface formed at the claw portion of each hook claw is engaged with the open edge of the entrance of the insertion hole. This engagement elastically deforms the deformable pieces, so that a pair of the hook claws are inserted in the insertion hole while approaching each other along a direction parallel with the outer side surface of the cover body. When the claw portions of the hook claws reach the exit of the insertion hole, the deformable pieces are restored from the elastically deformed state, so that the claw portions of the hook claws are hooked to the open edge of the exit of the insertion hole. Accordingly, the cover body is held at the closed position with respect to the case body.

In the structure disclosed in Japanese Laid-Open Patent Publication No. 2005-337064, a synthetic resin upper case is detachably attached to a synthetic resin lower case. A plurality of holding mechanisms for holding the upper case in a closed state with respect to the lower case are provided between the open ends of the lower case and the upper case. Each holding mechanism has a pair of hook portions formed on an outer side surface of the lower case. The hook portions have an L-shaped cross section and an inverted L-shaped transverse cross section, respectively. The hook portions are provided on and protrude from an outer side surface of the lower case with predetermined space therebetween. A pair of grooves are formed between each hook portion and an outer side surface of the lower case. A pair of hook claws, which correspond to the grooves, are formed on an outer side surface of the upper case. Each hook claw has at its distal end a claw portion that can be inserted into the grooves of the hook portion. The hook claws are each formed integrally with the upper case with a linear elastically deformable piece. The deformable pieces are formed to be elastically deformable along a direction parallel with the outer side surface of the upper case.

When the upper case is attached to and covers the lower case, a distal guide surface formed at the claw portion of each hook claw is engaged with the upper edge of the corresponding hook portion. This engagement elastically deforms the deformable pieces, so that a pair of the hook claws are inserted in the grooves of the hook portions while approaching each other along a direction parallel with the outer side surface of the upper case. When the claw portions of the hook claws reach the lower ends of the grooves, the deformable pieces are restored from the elastically deformed state, so that the claw portions of the hook claws are hooked to the lower edges of the hook portions. Accordingly, the upper case is held at the closed position with respect to the lower body.

In the conventional case locking mechanisms of the above described patent documents, the hook claws are integrally formed with the case part with a linear elastically deformable pieces in between. When the deformable pieces are elastically deformed in a direction parallel with the outer side surface of the case part, the claw portions of the hook claws are hooked to or unhooked from the open edge of the insertion hole or the edge of the hook portion. If such a structure is employed, the deformable pieces need to be greatly deformed to allow the hook claws to be hooked to and unhooked from the insertion hole or the hook portion. However, since the linear elastically deformable pieces are hard to be deformed, one of the case parts needs to be pressed toward the other case part with a great force when the case parts are closed. When the case parts are opened, the hook claws need to be deformed from the hooked position to the unhooked position with a great force against the elastic force of the deformable pieces. Therefore, the case parts are hard to close and open.

SUMMARY OF THE INVENTION

The present invention was made for solving the above problems in the prior art. One objective of the present invention is to provide a case locking mechanism that allows a pair of case parts to be closed and opened with a small force.

To achieve the foregoing objective and in accordance with one aspect of the present invention, a case locking mechanism is provided. The case locking mechanism is located between a first case part and a second case part, which are made of synthetic resin and are openable and closable. The locking mechanism holds the case parts in a closed state. The mechanism includes a projection, a deformable piece, a hook portion, a guide portion, and a holding portion. The projection is formed on an outer side surface of the first case part. The deformable piece is integrally formed with an outer side surface of the second case part, and has a folded back curved portion at a midpoint in the longitudinal direction. The deformable piece is elastically deformable in a direction perpendicular to the outer side surface of the second case part. The hook portion is formed at a distal portion of the deformable piece, and is engageable with the projection. The guide portion is formed on the projection. When the case parts are closed, the guide portion guides a claw portion formed in the hook portion in such a direction that the claw portion engages with the projection. A holding portion is formed on the projection to maintain the engaged state between the claw portion and the projection.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

Hereinafter, locking mechanisms according to a first embodiment of the present invention will be described with reference to FIGS. 1 to 5. The locking mechanisms are used in the case of an air cleaner connected to the intake system of a vehicle engine.

Figure 1:
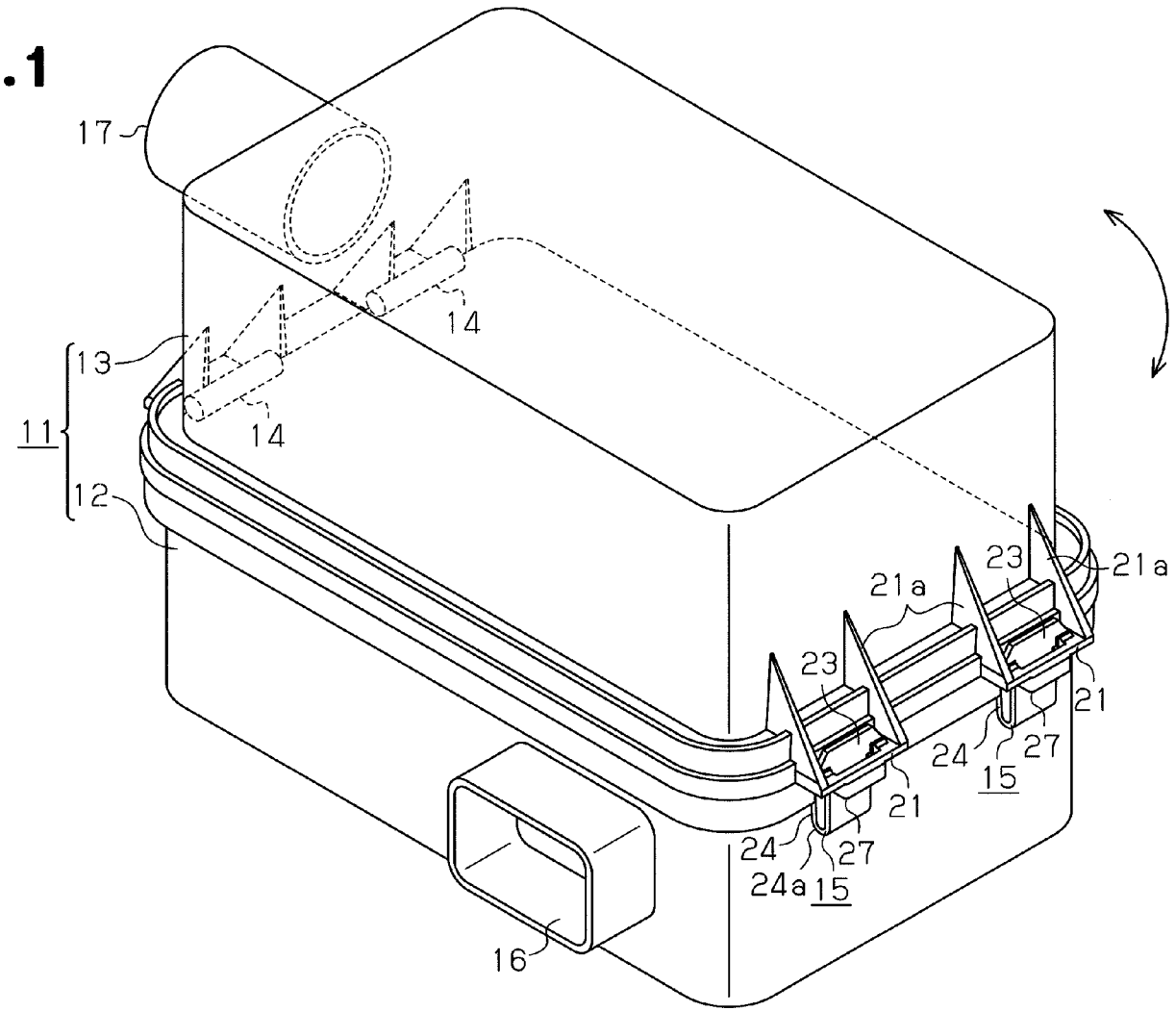
FIG. 1 is a perspective view illustrating an air cleaner having a locking mechanisms according to a first embodiment.

As shown in FIG. 1, a generally rectangular box-shaped case 11 of the air cleaner is formed by a synthetic resin lower case part 12 (a second case part) and a synthetic resin upper case part 13 (a first case part). The lower case part 12 opens upward as viewed in FIG. 1, and the upper case part 13 opens downward as viewed in FIG. 1. At the open edges of the case parts 12, 13, two hinges 14 are provided between the upper and lower sides. The hinges 14 pivotally couples the case parts 12, 13 to each other. The upper case part 13 is pivoted relative to the lower case part 12, so that the case parts 12, 13 are switched between an open state and a closed state. At the open edges of the case parts 12, 13, a pair of locking mechanisms 15 are provided between the upper and lower sides located opposite to the hinges 14. The locking mechanisms 15 hold the closed state of the case parts 12, 13.

Figure 2:
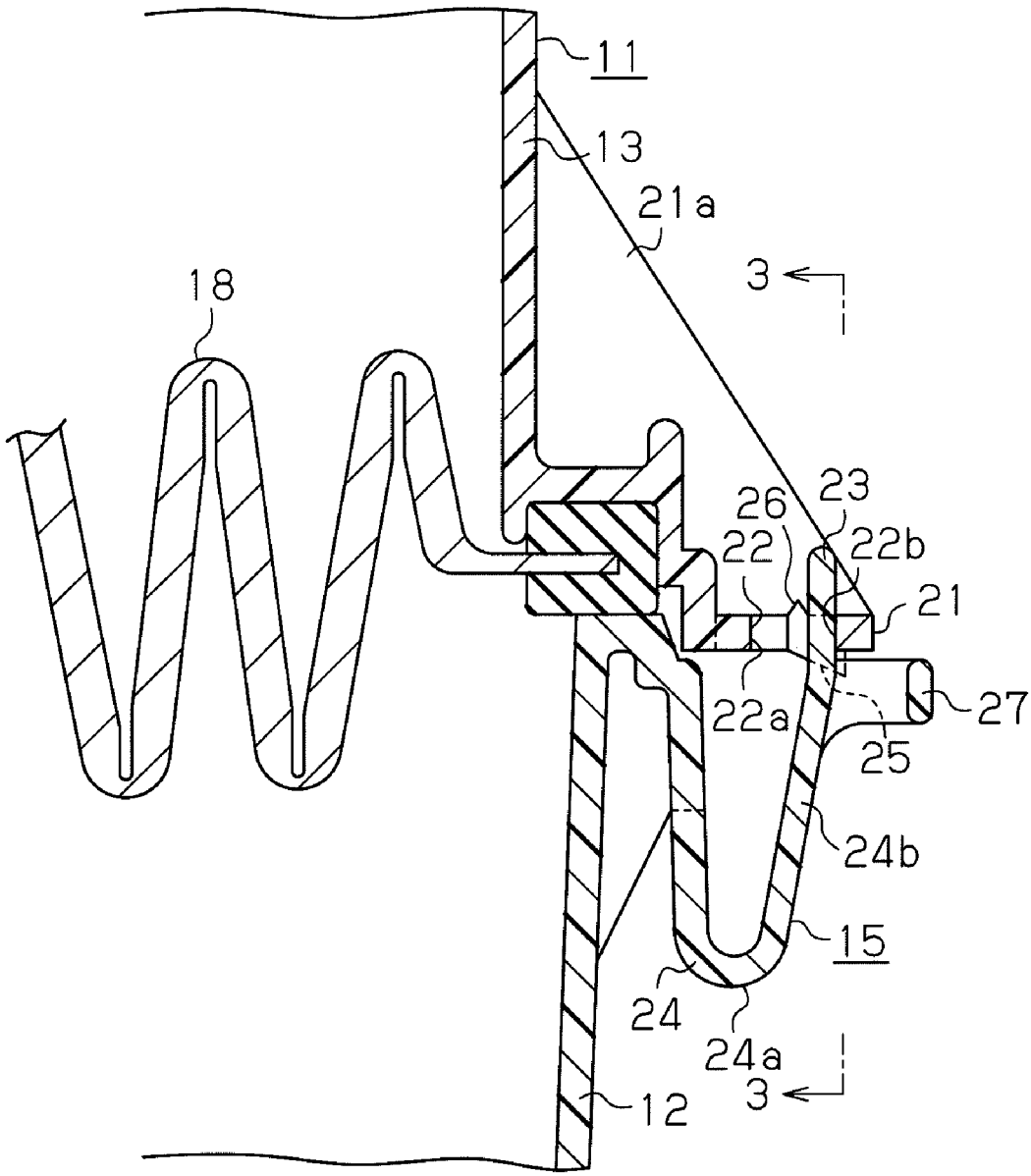
FIG. 2 is an enlarged cross-sectional view showing a main portion of the locking mechanism of FIG. 1.

As shown in FIGS. 1 and 2, an inlet 16 communicating with the atmosphere is formed in a side wall of the lower case part 12. An outlet 17 to be connected to the intake system of an engine is formed in a side wall of the upper case part 13. A filter 18 is detachably provided in the case 11 between the case parts 12, 13. The filter 18 filters air drawn to the engine.

Figure 3:
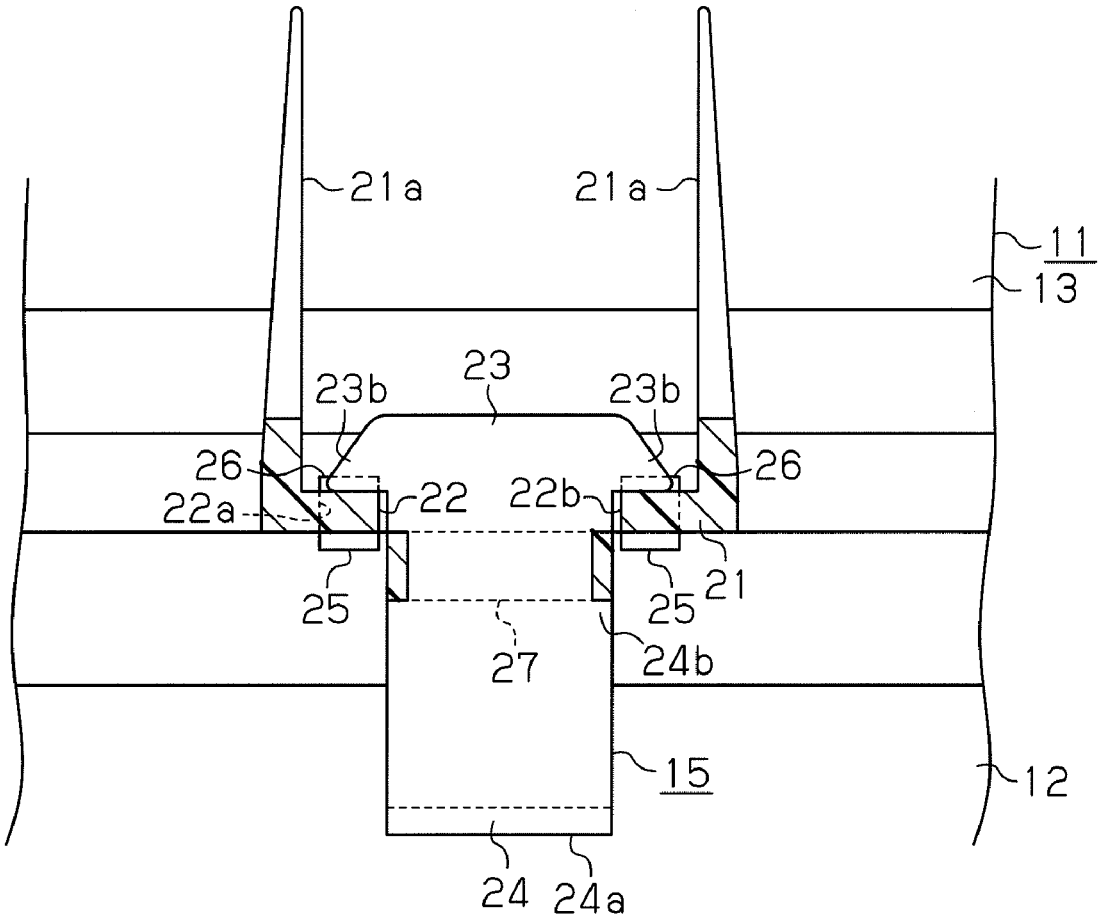
FIG. 3 is a cross-sectional view taken along line 3-3 of FIG. 2, showing the main portion.
Figure 4:
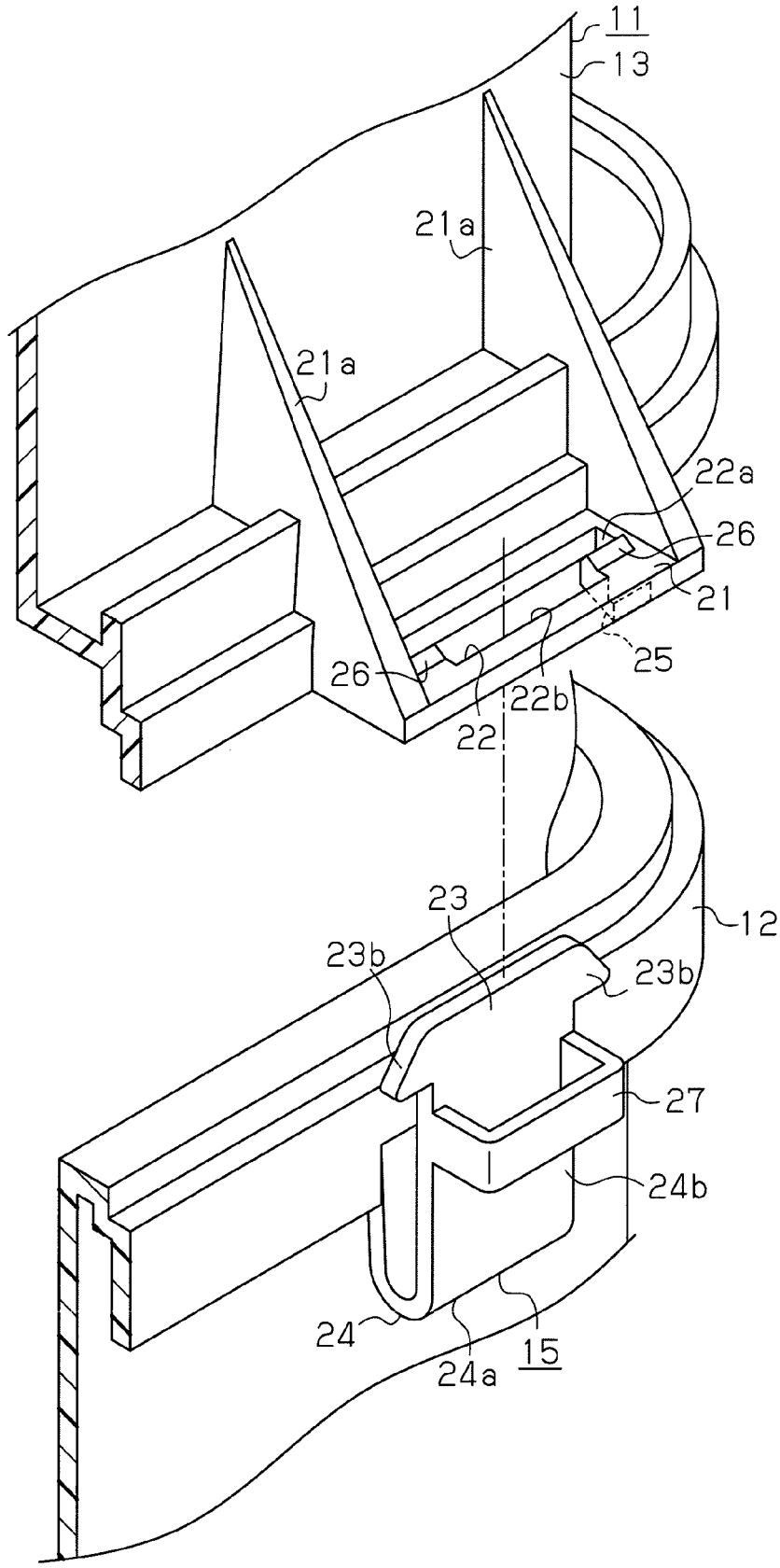
FIG. 4 is an exploded perspective view showing a locking mechanism of the case shown in FIG. 1.

The locking mechanism 15 will now be described. As shown in FIGS. 2 to 4, substantially flat plate-shaped projections 21 are formed on an outer side surface of the open edge of the upper case part 13. The projections 21 protrude toward the outside of the upper case part 13 and are integrally formed with the case part 13. An elongated stopper hole 22 is formed in each projection 21. The stopper hole 22 extends along the circumferential direction of the outer side surface of the upper case part 13.

Each stopper hole 22 includes a wide portion 22*a* and a narrow portion 22*b* adjacent to the wide portion 22*a*. The wide portion 22*a* is located closer to the upper case part 13 than the narrow portion 22*b*. The width (the lateral dimension as viewed in FIGS. 3 and 4) of the wide portion 22*a* is wider than the width (the lateral dimension as viewed in FIGS. 3 and 4) of the narrow portion 22*b*. A reinforcement portion 21*a* is located between each end of each projection 21 and the upper case part 13. The reinforcement portions 21*a* are integrally formed with the projections 21 and the upper case part 13 to reinforce the projections 21.

Elastically deformable pieces 24 are integrally formed with the lower case part 12 and located on the outer side surface of the open edge of the lower case part 12. A hook portion 23 is integrally formed with a distal portion 24*b* of each deformable piece 24. A folded back curved portion 24*a* is formed at a midpoint in the longitudinal direction of each deformable piece 24. Each deformable piece 24 is formed to have a substantially U shape as a whole. When the deformable portions 24 are elastically deformed, the hook portions 23 are moved in a direction perpendicular to the outer side surface of the lower case part 12. As shown in FIGS. 3 and 4, each hook portion 23 has a pair of substantially triangular claw portions 23*b*, which extend from both sides, in other words, leftward and rightward as viewed in FIGS. 3 and 4.

The distance between the claw portions 23*b*, in other words, the width of the hook portion 23, is slightly narrower than the width of the wide portion 22*a*. Thus, when the upper case part 13 is closed with respect to the lower case part 12, the claws 23*b* of each hook portion 23 enters the wide portion 22*a* of the corresponding stopper hole 22.

The width of the distal portion 24*b* of each deformable piece 24 is slightly narrower than the width of the narrow portion 22*b*. Therefore, when the claw portions 23*b* of each hook portion 23 has entered the wide portion 22*a* of the corresponding stopper hole 22, the distal portion 24*b* of the deformable piece 24 is allowed to move into the narrow portion 22*b* of the stopper hole 22.

The width of the hook portion 23 is wider than the width of the narrow portion 22*b*. Thus, when the distal portion 24*b* is located in the narrow portion 22*b*, the hook portion 23 can be hooked to the upper surface of the projection 21.

Figure 5B:
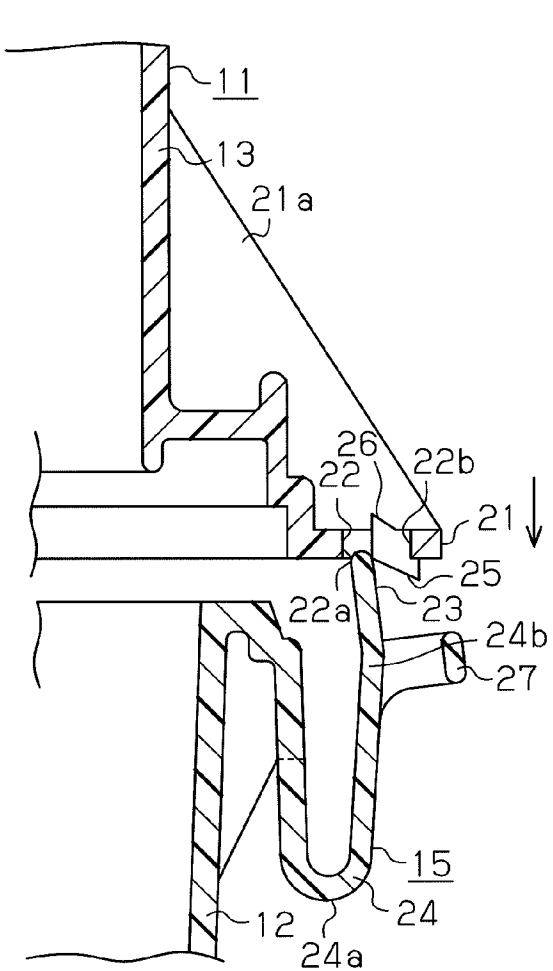
FIGS. 5(*a*) and 5(*b*) are cross-sectional views sequentially showing the operation for engaging the locking mechanism.
Figure 5A:
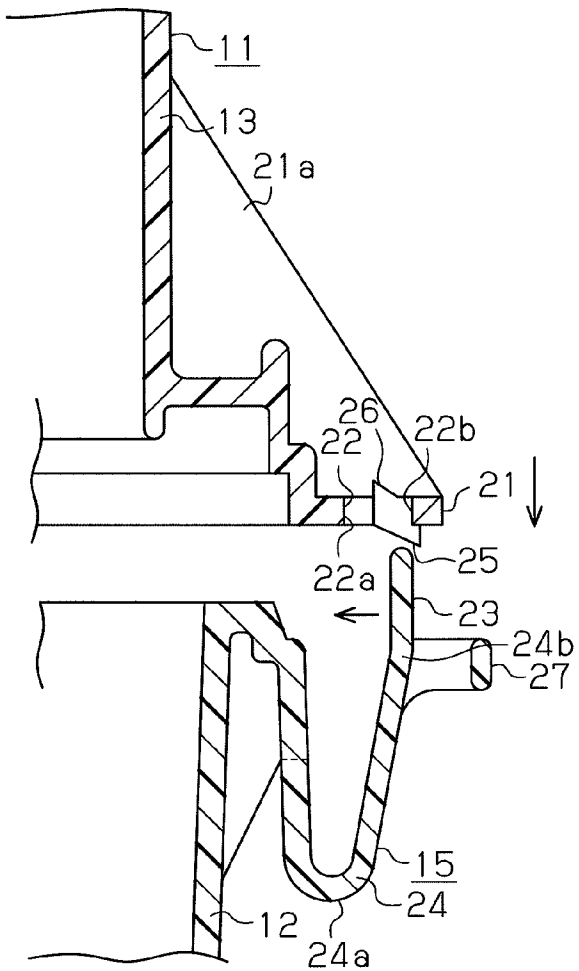

As shown in FIGS. 2 and 3, a pair of inclined guide portions 25 are formed on both sides of the narrow portion 22*b* of the stopper hole 22 on the lower surface of each projection 21. Each pair of the inclined guide portions 25 guide the claw portions 23*b* of the corresponding hook portion 23 to the wide portion 22*a* of the stopper hole 22. As shown in FIG. 5(*a*), when the upper case part 13 is closed with respect to the lower case part 12, each of the above described deformable pieces 24 is arranged such that its hook portion 23 faces the corresponding inclined guide portions 25.

As shown in FIG. 4, a pair of chevron-shaped holding portions 26 are formed on both sides of the narrow portion 22*b* of the stopper hole 22 on the upper surface of each corresponding projection 21. The holding portions 26 are formed to extend along the widthwise direction of the narrow portion 22*b*. When the claw portions 23*b* of each hook portion 23 is inserted into the corresponding wide portion 22*a*, and the distal portion 24*b* of the deformable piece 24 is moved to the narrow portion 22*b* of the corresponding stopper hole 22, the claw portions 23*b* of the hook portion 23 are hooked to and held by the holding portions 26.

As shown in FIGS. 2 and 4, a manipulation portion 27 is provided on the outer side surface of each hook portion 23. The manipulation portion 27 is integrally formed with the hook portion 23 and protrudes from the hook portion 23. When the manipulation portions 27 are pressed and the deformable portions 24 are elastically deformed in the state where the claw portions 23*b* of each hook portion 23 are hooked to the corresponding holding portions 26, the hook portions 23 approach the outer side surface of the lower case part 12. Accordingly, the claw portions 23*b* of each hook portion 23 are moved along the inclined surfaces of the holding portions 26, so that the claw portions 23*b* of the hook portion 23 are released from the hooked state with the holding portions 26.

An operation of the case locking mechanisms 15 thus constructed will now be described.

When the case parts 12, 13 are switched from the open state to the closed state, the upper case part 13 is moved relative to the lower case part 12 so that the upper case part 13 approaches the lower case part 12. Accordingly, as shown in FIG. 5(*a*), each claw portion 23*b* of each hook portion 23 is engaged with the inclined guide portion 25 at the entrance of the corresponding stopper hole 22. When the upper case part 13 is further pivoted relative to the lower case part 12, each deformable piece 24 is elastically deformed as shown in FIG. 5(*b*) by the guiding action of the inclined guide portions 25, so that the corresponding hook portion 23 is moved toward the outer side surface of the lower case part 12. When the hook portion 23 is moved to a position that corresponds to the wide portion 22*a* of the stopper hole 22, the claw portions 23*b* of the hook portion 23 enters the wide portion 22*a*.

Thereafter, when the claw portions 23*b* of the hook portion 23 are inserted into the wide portion 22*a*, the deformable piece 24 is restored from the elastically deformed state as shown in FIG. 2, so that the hook portion 23 is moved away from the outer side surface of the lower case part 12. Accordingly, the distal portion 24*b* of the deformable piece 24 is moved to the narrow portion 22*b* of the stopper hole 22, and the claw portions 23*b* of the hook portion 23 are moved onto the holding portions 26 located on both sides of the narrow portion 22*b*. When the claw portions 23*b* of the hook portion 23 are moved over the holding portions 26 on the projection 21 and engaged with the holding portions 26, the claw portions 23*b* are held in the stopper hole 22. As a result, the case parts 12, 13 are held in the closed state.

When the case parts 12, 13 are opened from the closed state shown in FIG. 2, the manipulation portions 27 of the deformable portions 24 are pressed toward the outer side surface of the lower case part 12. This elastically deforms the deformable pieces 24, so that each hook portion 23 approaches the outer side surface of the lower case part 12. Accordingly, the claw portions 23*b* of the hook portion 23 are moved to the wide portion 22*a* of the stopper hole 22 on the upper surface of the projection 21. When the claw portions 23*b* are moved to the wide portion 22*a* of the stopper hole 22, the claw portions 23*b* are allowed to be released downward, which cancels the closed state the case parts 12, 13. In this sate, if the upper case part 13 is pivoted from the lower case part 12 in the opening direction, the claw portions 23*b* of the hook portion 23 escapes the wide portion 22*a* of the stopper hole 22 as shown in FIG. 5(*b*), and the case parts 12, 13 are switched to the open state.

The present embodiment described above has the following advantages.

(1) The hook portions 23 for holding the case parts 12, 13 in the closed state are integrally formed with the lower case part 12 with the deformable pieces 24 in between. This prevents the number of components of the case locking mechanisms 15 from being increased, and simplifies the locking mechanism 15.

(2) Each deformable piece 24 is U-shaped, and elastically deformable in a direction perpendicular to the outer side surface of the lower case part 12. When an operation for closing the case parts 12, 13 from the open state is performed, the deformable pieces 24 are elastically deformed in a direction perpendicular to the outer side surface of the lower case part 12, so that the claw portions 23*b* of each hook portion 23 enter and are hooked to the corresponding stopper hole 22. Therefore, by pivoting the upper case part 13 to press the upper case part 13 against the lower case part 12 with a small force, the case parts 12, 13 are easily held in the closed state. When opening the case parts 12, 13 from the closed state, the claw portions 23*b* of each hook portion 23 are separated from the corresponding holding portions 26 by pressing the hook portion 23 at the manipulation portion 27 by a small force. The case parts 12, 13 are thus easily opened.

(3) When the case parts 12, 13 are switched form the open state to the closed state, each hook portion 23 is guided to the wide portion 22*a* of the corresponding stopper hole 22 by the inclined guide portions 25. Therefore, the hook portion 23 does not need to be brought into contact with the wide portion 22*a* of the stopper hole 22, and the case parts 12, 13 are easily switched from the open state to the closed state.

Second Embodiment

A second embodiment of the present invention will now be described. Differences from the first embodiment will mainly be discussed.

Figure 6:
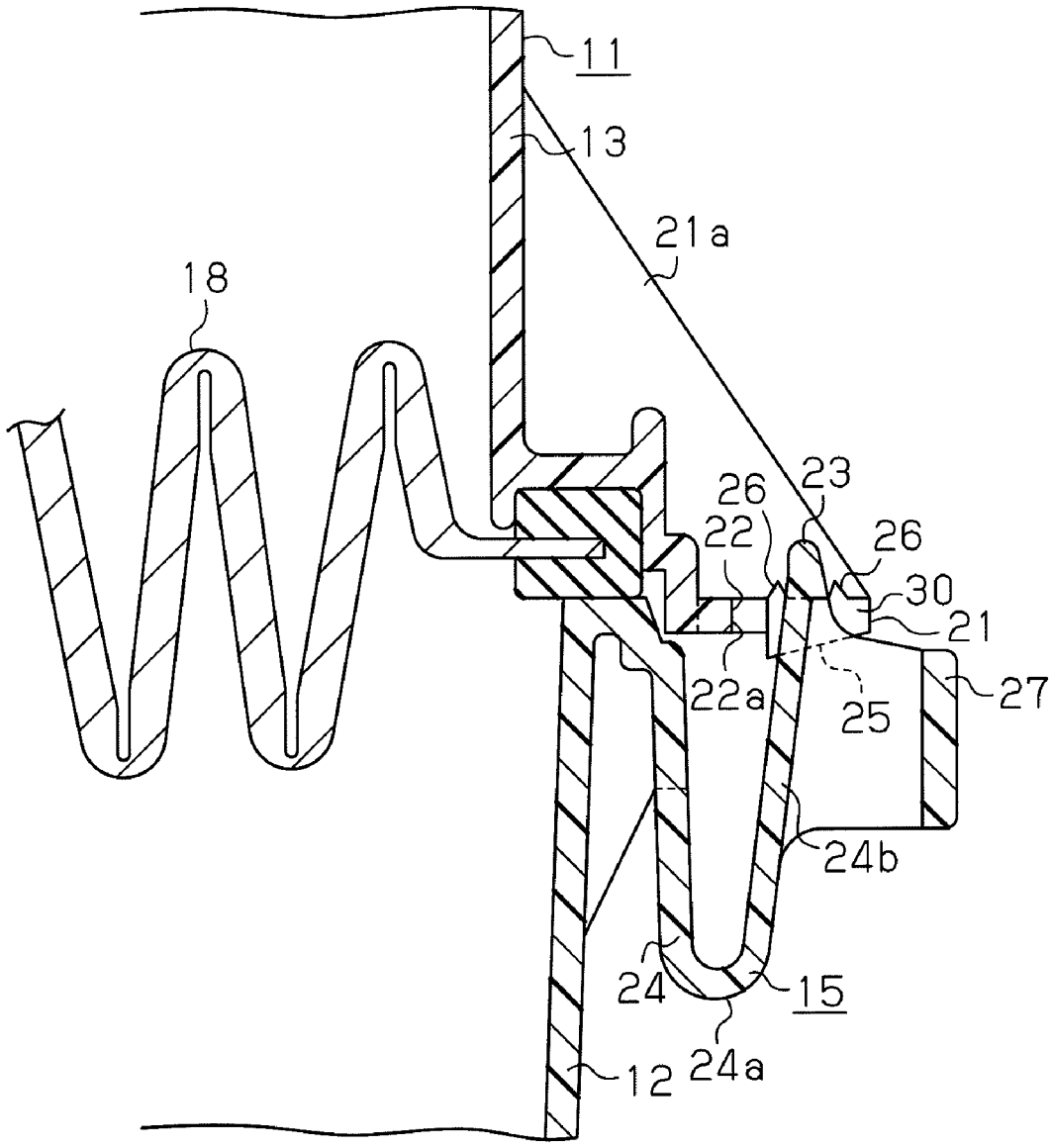
FIG. 6 is a cross-sectional view illustrating a main portion of a case locking mechanism according to a second embodiment.
Figure 7:
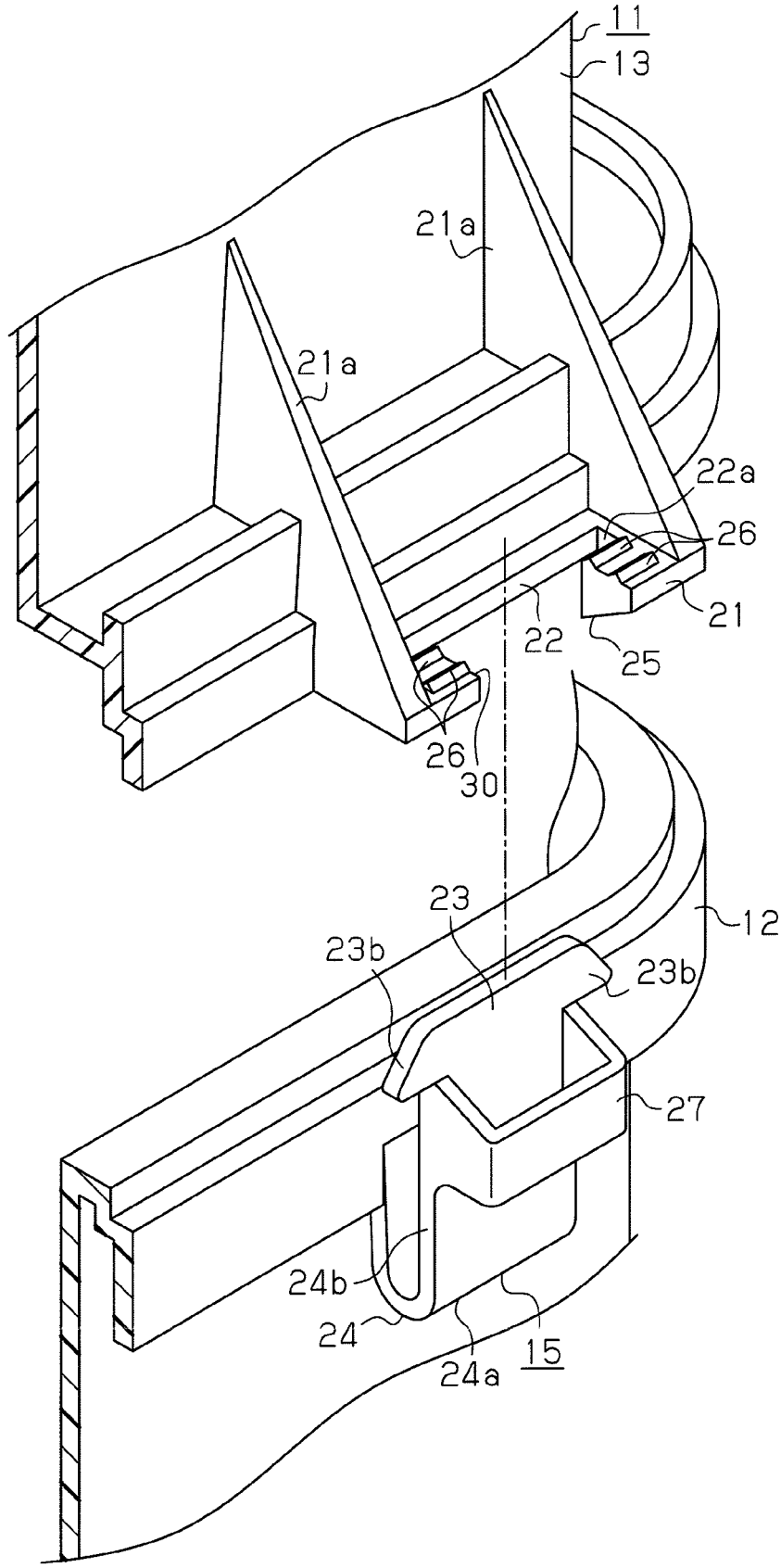
FIG. 7 is an exploded perspective view showing the locking mechanism of the case shown in FIG. 6.
Figure 8B:
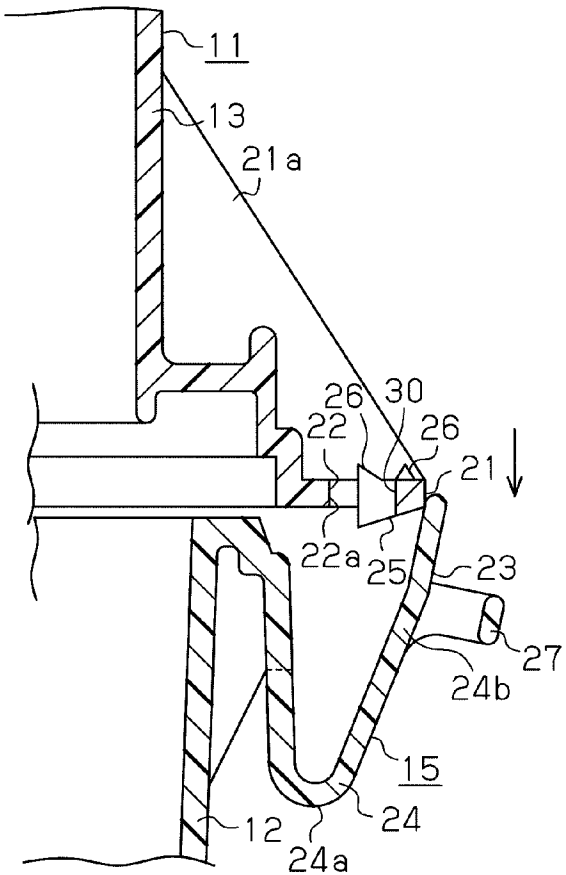
FIGS. 8(*a*) and 8(*b*) are cross-sectional views sequentially showing the operation for engaging the locking mechanism.
Figure 8A:
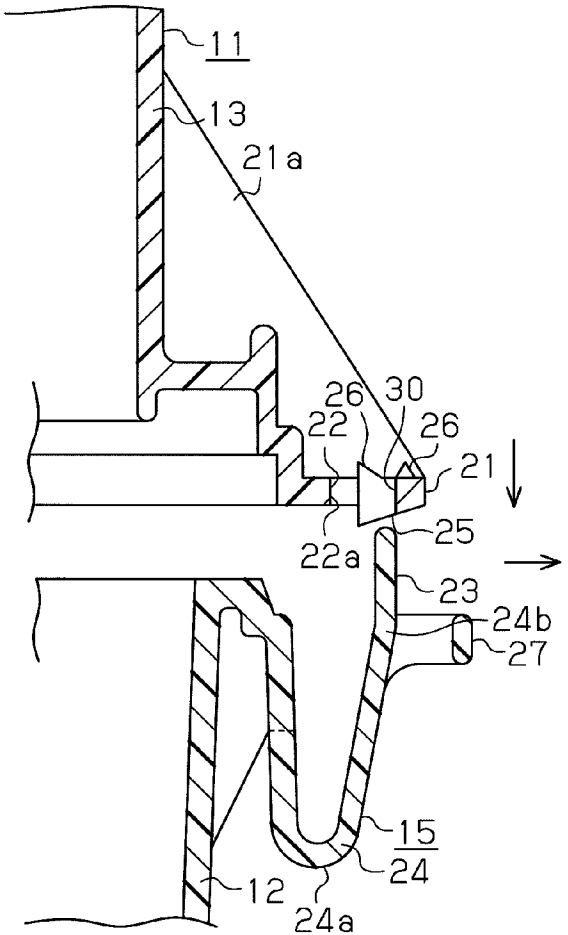

According to the second embodiment, the narrow portion 22*b* of the stopper hole 22 of the first embodiment is replaced by a stopper cutout portion 30. As shown in FIGS. 6 to 8, the stopper cutout portion 30 is located in the projection 21 at a center of a portion adjacent to the wide portion 22*a* from the out side. The stopper cutout portion 30 opens to the outside. As in the first embodiment, the width of the wide portion 22*a* is wider than the width of the hook portion 23. The width of the stopper cutout portion 30 is slightly wider than the width of the distal portion 24*b* of the deformable piece 24, and is narrower than the width of the hook portion 23.

In the second embodiment, the direction of inclination of the inclined guide portions 25 formed in each projection 21 is opposite to that of the direction of inclination of the inclined guide portion in the first embodiment. That is, the inclined guide portions 25 of the second embodiment guide the hook portion 23 toward the distal end of the projection 21, in other words, in the direction toward the opening of the stopper cutout portion 30.

A pair of chevron-shaped holding portions 26 are formed with a space therebetween at each side of the stopper cutout portion 30 on the upper surface of the projection 21. When the distal portion 24*b* of the deformable piece 24 is moved into the stopper cutout portion 30, and the claw portions 23*b* of the hook portion 23 are moved onto the projections 21, each claw portion 23*b* is hooked to and held by the recess between the corresponding holding portions 26.

When the case parts 12, 13 are switched from the open state to the closed state, the upper case part 13 is moved relative to the lower case part 12 so that the upper case part 13 approaches the lower case part 12. Accordingly, as shown in FIGS. 8(*a*) and 8(*b*), each claw portion 23*b* of each hook portion 23 is engaged with the inclined guide portion 25 at the entrance of the corresponding stopper hole 22. Each deformable piece 24 is elastically deformed by the guiding action of the inclined guide portions 25, so that the hook portion 23 is moved toward the distal end of the projection 21, or toward the open side of the stopper cutout portion 30.

When the manipulation portions 27 are pressed so that the distal portion 24*b* of each deformable piece 24 is pressed into the corresponding stopper cutout portion 30 in the state where the distal portion 24*b* has been moved to a position that corresponds to the corresponding stopper cutout portion 30, the claw portions 23*b* of the hook portion 23 are each hooked to and held at the recess between the corresponding the holding portions 26. As a result, the case parts 12, 13 are held in the closed state.

When the case parts 12, 13 are switched from the closed state to the open state, the manipulation portions 27 are pressed toward the lower case part 12. This elastically deforms the hook portions 23 toward the outer side surface of the lower case part 12, so that the claw portions 23*b* of each hook portion 23 are moved from the projection portions 21 to the wide portion 22*a* of the stopper hole 22. Accordingly, the claw portions 23*b* of the hook portion 23 are separated from the holding portions 26, so that the case parts 12, 13 are released from the closed state. Thereafter, if the upper case part 13 is pivoted from the lower case part 12 in the opening direction, the claw portions 23*b* of the hook portion 23 escapes the wide portion 22*a* of the stopper hole 22 as in the first embodiment, and the case parts 12, 13 are switched to the open state.

The second embodiment therefore provides substantially the same advantages as the first embodiment.

The present invention may be embodied in the following modifications.

In the first and second embodiments, the locking mechanisms 15 are provided at the open edges of the case parts 12, 13 and only at the pair of sides that are opposite to the hinges 14. However, in the four sides of the open edges of the case parts 12, 13, the locking mechanism 15 may be provide in two or three sides in which the hinges 14 are not provided.

In the illustrated embodiment, the projections 21 and the stopper holes 22 are formed in the upper case part 13, and the hook portions 23 are formed in the lower case part 12. However, the projections 21 and the stopper holes 22 may be formed in the lower case part 12, and the hook portions 23 may be formed in the upper case part 13.

In the illustrated embodiments, the present invention is applied to the locking mechanisms of the case of the air cleaner connected to the intake system of a vehicle engine. However, the present invention may be applied to locking mechanisms used in other types of cases such as an electric junction box for accommodating fuses and capacitors in a vehicle.

Therefore, the present examples and embodiments are to be considered as illustrative and not restrictive and the invention is not to be limited to the details given herein, but may be modified within the scope and equivalence of the appended claims.

What is claimed is:

1. A case locking mechanism located between a first case part and a second case part, which are made of synthetic resin and are openable and closable, wherein the locking mechanism holds the case parts in a closed state, the mechanism comprising:

a projection formed on an outer side surface of the first case part;

a deformable piece that is integrally formed with an outer side surface of the second case part, and has a folded back curved portion at a midpoint in a longitudinal direction, wherein the deformable piece is elastically deformable in a first direction perpendicular to the outer side surface of the second case part;

a hook portion formed at a distal portion of the deformable piece, the hook portion being engageable with the projection;

a guide portion formed on the projection, wherein, when the case parts are closed, the guide portion guides a claw portion formed in the hook portion in such a direction that the claw portion engages with the projection; and a holding portion that is formed on the projection to maintain the engaged state between the claw portion and the projection, wherein the projection includes an elongated stopper hole extending in a circumferential direction of the outer side surface of the first case part, wherein the stopper hole includes a wide portion and a narrow portion, the narrow portion being formed in a center portion of the projection adjacent to the wide portion, a width of the narrow portion being less than a width of the wide portion, wherein a width of the hook portion is greater than the width of the narrow portion and less than the width of the wide portion, and wherein, when the case parts are closed, the deformable piece is elastically deformed in the first direction so that the hook portion is moved to a position that corresponds to the wide portion and inserted into the wide portion, thereafter the deformable piece is restored from being elastically deformed so that the hook portion is moved in a direction opposite to the first direction and engages with an upper surface of the projection outside of the wide portion of the stopper hole.

2. The case locking mechanism according to claim 1, wherein the guide portion is formed in such a manner as to guide the hook portion toward the wide portion when the case parts are closed, wherein the holding portion is formed in a position that corresponds to the narrow portion, and wherein a width of the distal portion of the deformable piece is less than the width of the narrow portion.

3. The case locking mechanism according to claim 1, wherein a manipulation portion is formed on the outer side surface of the hook portion below the projection and protrudes beyond the projection in the direction perpendicular to the outer side surface of the second case part, the manipulation portion being used for releasing the claw portion of the hook portion from the hooked state at the holding portion.

4. The case locking mechanism according to claim 2, wherein the holding portion is formed on the upper surface of the projection at each side of the narrow portion in a width direction of the projection to engage the claw portion of the hook portion.

* * * * *